US008727262B2

(12) United States Patent
Underbrink et al.

(10) Patent No.: US 8,727,262 B2
(45) Date of Patent: May 20, 2014

(54) CABLE DESPOOLING AND SPOOLING

(75) Inventors: James Robert Underbrink, Seattle, WA (US); Donn Matthew Perkins, Seattle, WA (US); George R. Aguayo, Mukilteo, WA (US)

(73) Assignee: The Boeing Company, Chicago, IL (US)

( * ) Notice: Subject to any disclaimer, the term of this patent is extended or adjusted under 35 U.S.C. 154(b) by 703 days.

(21) Appl. No.: 11/957,404

(22) Filed: Dec. 14, 2007

(65) Prior Publication Data

US 2009/0152390 A1 Jun. 18, 2009

(51) Int. Cl.
*B65H 75/24* (2006.01)

(52) U.S. Cl.
USPC ..... 242/573; 242/574.4; 242/577.4; 242/604; 242/605

(58) Field of Classification Search
USPC ..... 242/577, 577.4, 607.1, 577.3, 577.2, 242/577.1, 571, 604.1, 604, 407.1, 572, 242/573, 574.4, 574, 605, 118.41, 118.1, 242/570, 576, 588, 606
See application file for complete search history.

(56) References Cited

U.S. PATENT DOCUMENTS

| | | | | | |
|---|---|---|---|---|---|
| 358,705 | A * | 3/1887 | Smith | 242/118.41 |
| 538,939 | A * | 5/1895 | Warren et al. | 242/574.4 |
| 1,674,709 | A * | 6/1928 | Thomas | 242/407.1 |
| 1,728,106 | A * | 9/1929 | Collins | 242/577 |
| 1,827,855 | A * | 10/1931 | Parker | 242/574.4 |
| 1,902,611 | A * | 3/1933 | Blackman et al. | 242/561 |
| 2,154,343 | A * | 4/1939 | McDermott | 242/571.5 |
| 2,318,906 | A * | 5/1943 | Troche et al. | 242/574.4 |
| 3,680,809 | A * | 8/1972 | Blackmer et al. | 242/605 |
| 3,815,842 | A * | 6/1974 | Scrogin | 242/423.1 |
| 3,931,941 | A * | 1/1976 | Hornbuckle | 242/576.1 |
| 5,025,999 | A * | 6/1991 | Littrell | 242/577 |
| 6,527,220 | B2 * | 3/2003 | Weaver et al. | 242/603 |
| 6,634,592 | B1 | 10/2003 | Berousek | |
| 6,655,627 | B2 * | 12/2003 | Patton | 242/397.2 |
| 6,722,607 | B2 * | 4/2004 | Weaver et al. | 242/603 |
| 7,494,088 | B2 * | 2/2009 | Wadle' | 242/573.9 |

* cited by examiner

*Primary Examiner* — Sang Kim
*Assistant Examiner* — Juan Campos, Jr.
(74) *Attorney, Agent, or Firm* — Hugh P. Gortler

(57) ABSTRACT

In some embodiments, a cable spool includes a hub having an outer surface that is retractable and expandable, and a single end plate affixed to an end of the hub. In other embodiments, an apparatus includes an assembly of cascaded, temporarily interlocked spools that can be used for simultaneous despooling or spooling of multiple cable coils.

12 Claims, 7 Drawing Sheets

CABLE DESPOOLING AND SPOOLING

BACKGROUND

In the test and measurement environment, cables are despooled and then spooled while setting up and tearing down instrumentation. Large amounts of cable can be involved.

Consider deploying twenty to fifty bundles of cable, with each bundle weighing 30-60 pounds. Laying down and picking up such cable by hand in tight quarters is time consuming, physically demanding, and ergonomically challenging.

SUMMARY

According to an embodiment of the present invention a cable spool includes a hub having an outer surface that is retractable and expandable, and a single end plate affixed to an end of the hub. According to another embodiment of the present invention, an apparatus includes an assembly of cascaded, temporarily interlocked spools that can be used for simultaneous despooling or spooling of multiple cable coils.

DETAILED DESCRIPTION

Figure 1:
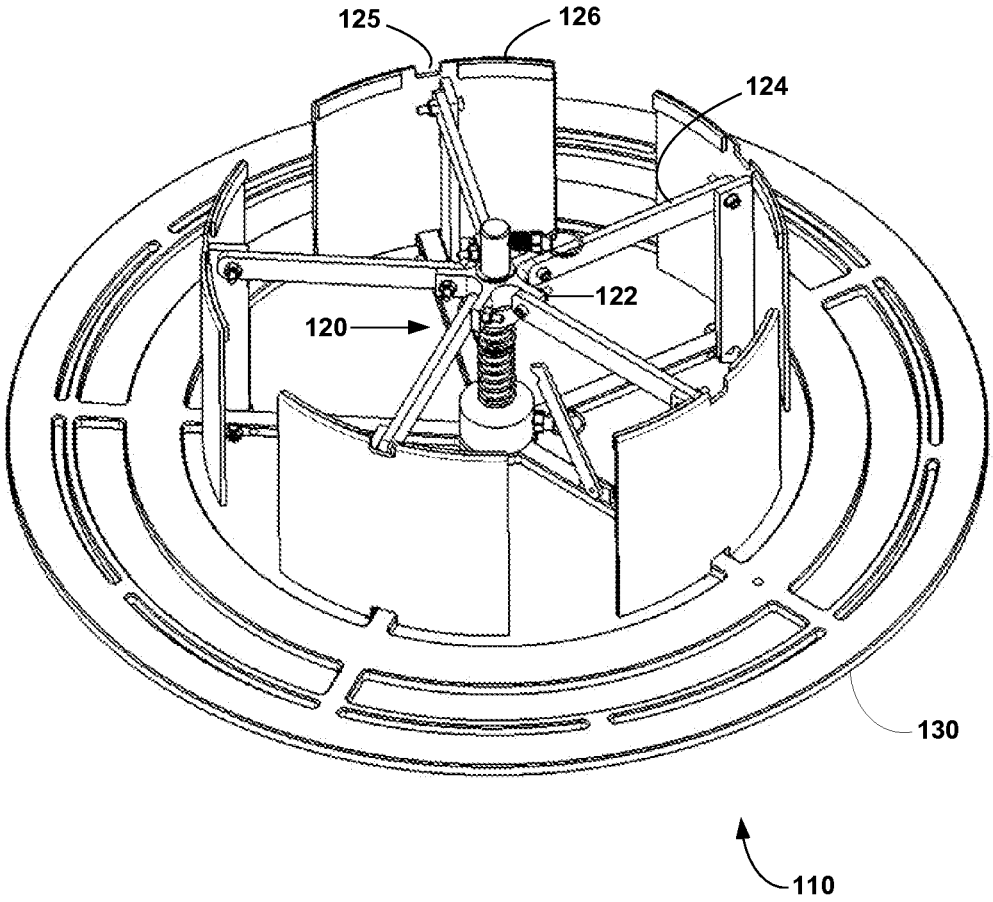
FIG. 1 is an illustration of a spool in accordance with an embodiment of the present invention.

As shown in the drawings for purposes of illustration, the present invention is embodied in the spooling and despooling of cables. The cables are not limited to any particular type. Examples of cables include, without limitation, multi-conductor cables, coaxial cables, fiber optic cables, power cables, multi-cable bundles, etc. For the purposes herein, the cables may also include flexible tubing and strands of wires.

Reference is made to FIG. 1, which illustrates a cable spool 110. The spool 110 includes a hub 120 and a single end plate 130 affixed to an end of the hub 120. The hub 120 includes a center body 122, arms 124 that extend radially outward from the center body 122, and surface pieces 126 at ends of the arms 124. The surface pieces 126 form a discontinuous hub surface.

Figure 2:
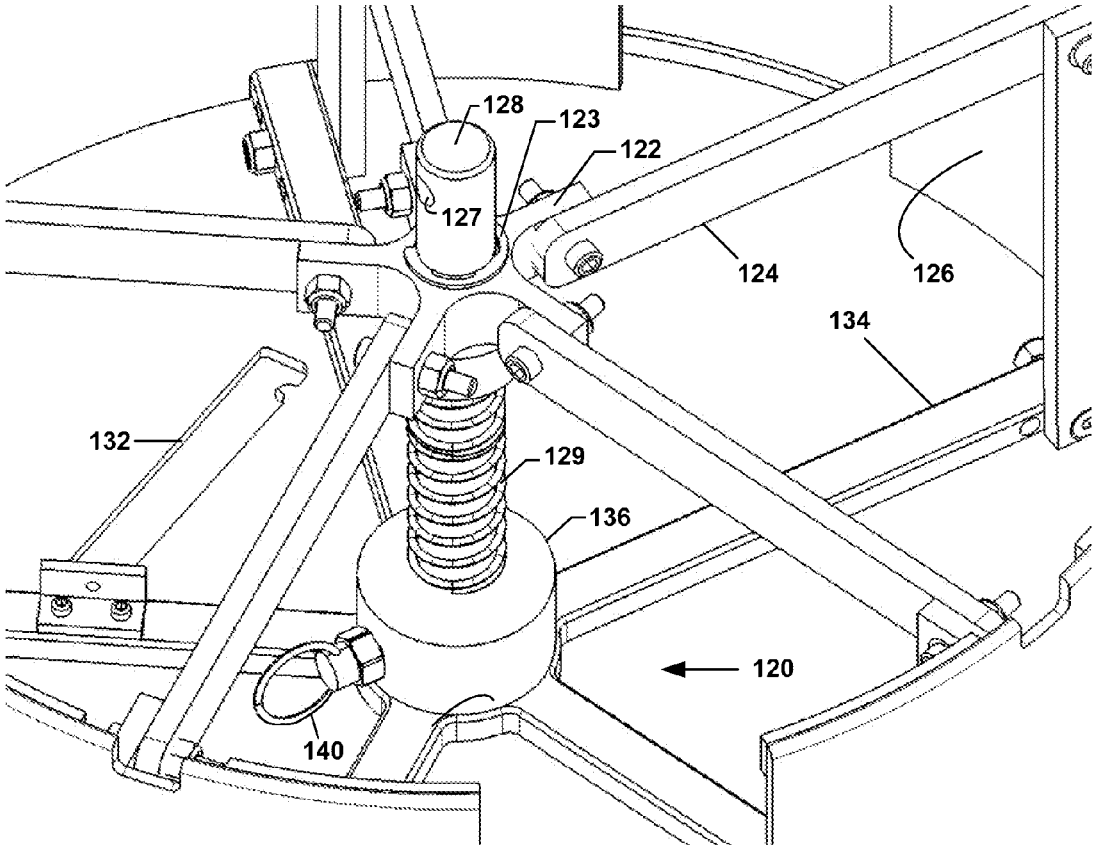
FIG. 2 is an enlarged view of a spool hub in accordance with an embodiment of the present invention.

Additional reference is made to FIG. 2, which illustrates an enlarged view of the hub 120. The center body 122 is movable along a center shaft 128, and each arm 124 is hinged to the center body 122 and a surface piece 126. The surface pieces 126 pivot on the spokes 134 of the end plate 130. A spring 129 biases the center body 122 away from the end plate 130. When the center body 122 is in a fully extended position, the arms 124 are extended, and the hub surface is fully expanded (as illustrated in FIG. 1). Pushing the center body 122 toward the end plate 130 and against the spring 129 causes the arms 124 to pull the surface pieces 126 inward, thereby causing the hub surface to retract. A locking arm 132 engages the head of a bolt to keep the hub surface fully retracted. When the locking arm 132 is released, the spring 129 biases the center body 122 away from the end plate 130, causing the hub surface to expand. A stop 123 on the center shaft 128 (e.g., a C-Ring attached to the center shaft 128) limits the travel of the center body 122 away from the end plate 130. When the center body 122 hits the stop 123, the hub surface is fully expanded, and the ends of the arms 124 at the center body 122 are slightly farther away from the end plate 130 than the ends of the arms 124 at the surface pieces 126.

Figure 3:
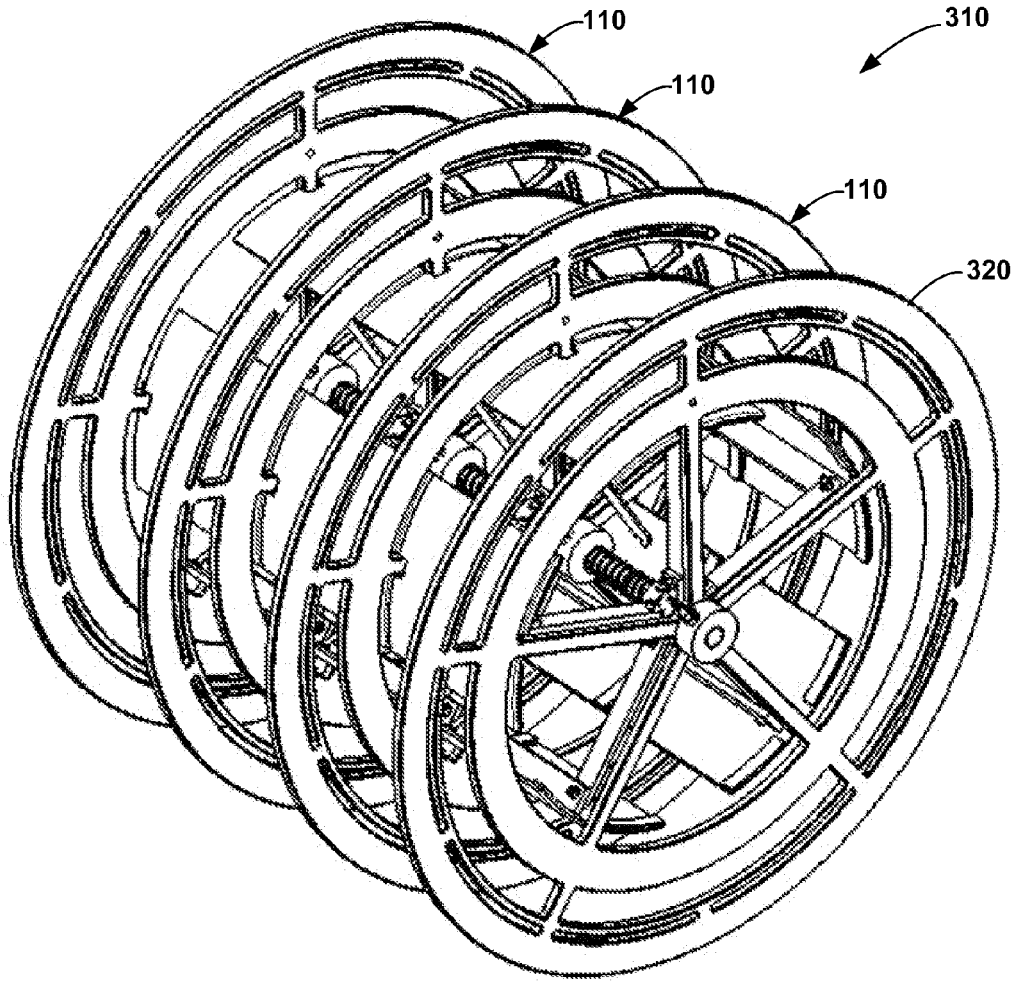
FIG. 3 is an illustration of a spool assembly in accordance with an embodiment of the present invention.

Reference is now made to FIG. 3. Several of these spools 110 can be cascaded to form a spool assembly 310 for multiple spooling and despooling. The end plate 130 of the second spool 110 forms a terminating plate for the first spool 110, the end plate 130 of the third spool 110 forms a terminating plate for the second spool 110, and so on. The last spool 110 in the assembly 310 may be terminated with an end plate 320.

FIG. 2 illustrates an example of how the spools 110 in the assembly 310 can be temporarily interlocked. Each center shaft 128 has a free end and a through-hole 127 near the free end. A spring-loaded locking pin 140 can be inserted into the through-hole 127. To interlock one spool 110 to another spool 110, the free end of the center shaft 128 of the one spool 110 is inserted into a bearing 136 of the other spool 110. The spring-loaded pin 140 of the other spool 110 is held in a retracted position while the free end of the shaft 128 of the one spool is inserted into the bearing 136 of the other spool. The spring-loaded pin 140 is then released so as to engage the through-hole 127. The spool bearings 136 have ample bearing surface when the spools 110 are cascaded and interlocked so the interlocked assembly 310 is rigid and robust. The spring-loaded pin 140 allows the spools 110 to be interlocked quickly. An end plate 320 can be locked to the last spool 110 in a similar manner.

To further facilitate interlocking, cutouts 125 in the end pieces 126 of a hub 120 engage the spokes 134 of the end plate 130 of the next spool 110. This feature is best seen in FIG. 1.

In some embodiments, the hub 120 is expanded before an end plate 130 is added. In other embodiments, the hub 120 may be expanded after an end plate 130 is added.

Figure 4:
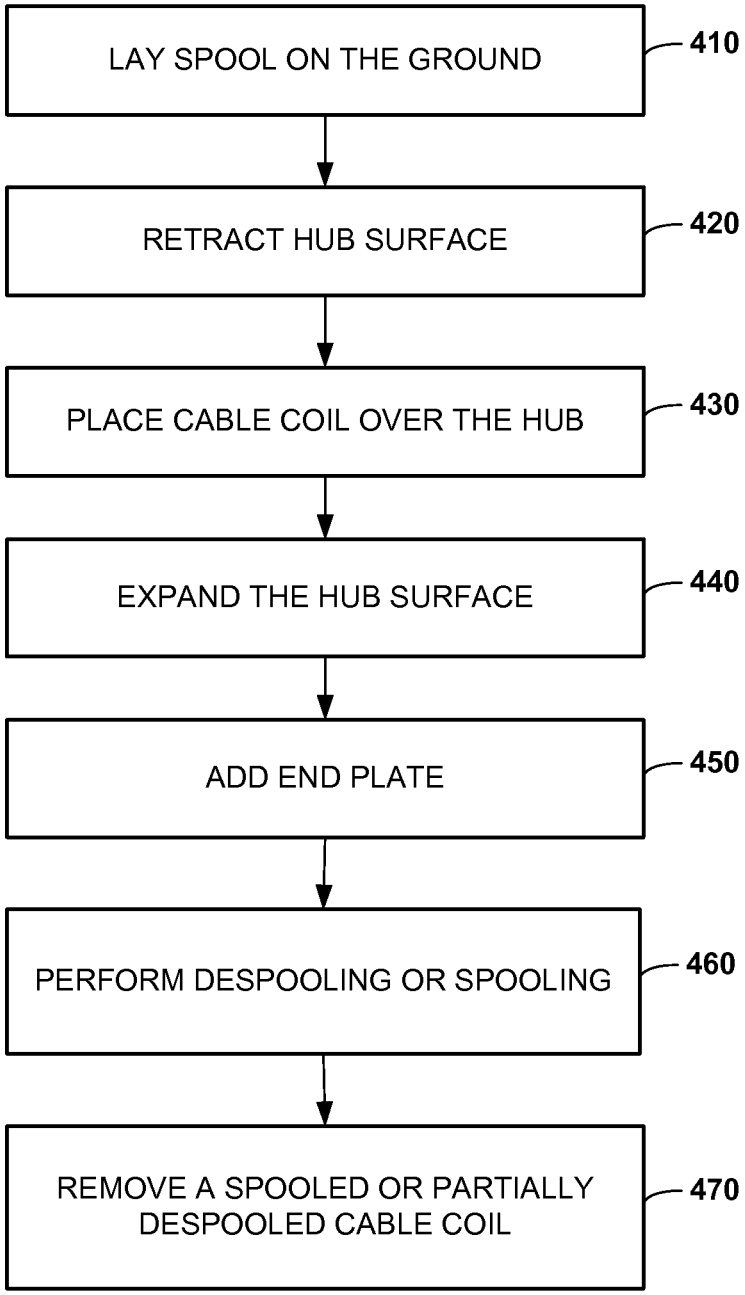
FIG. 4 is an illustration of a method of using a spool in accordance with an embodiment of the present invention.

Reference is now made to FIG. 4, which illustrates a method of using a single spool. At block 410, the spool is laid flat on the ground. In this position, the end plate is resting on the ground, with the hub extending upward.

At block 420, the hub surface is retracted by pressing down on the center body. The locking arm keeps the hub surface in a retracted position.

Figure 5A:
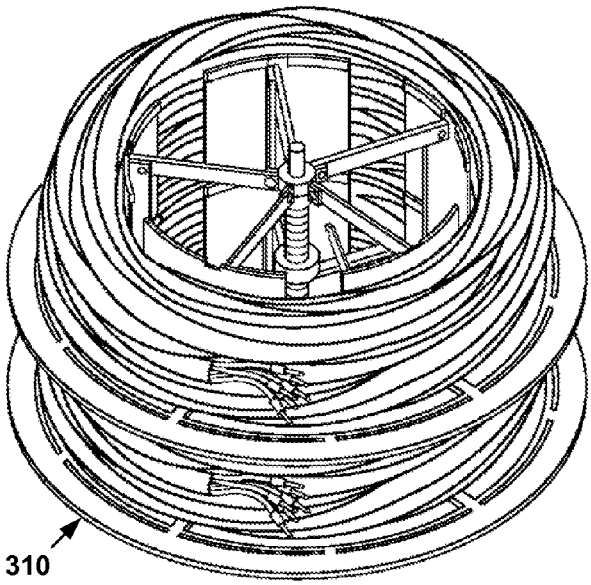
FIGS. 5*a* and 5*b* are illustrations of fully and partially coiled cables on a spool in accordance with an embodiment of the present invention.
Figure 5B:
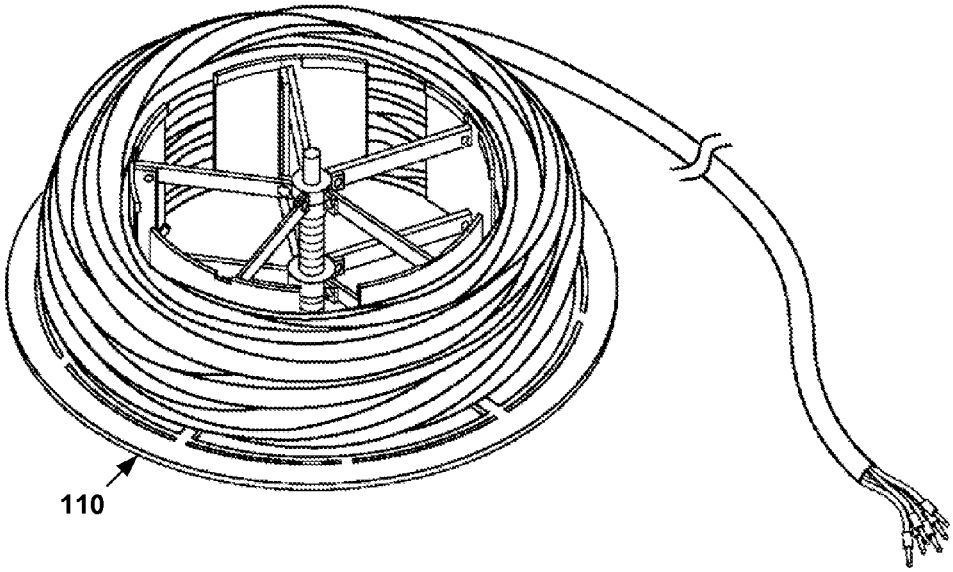

At block 430, a cable coil is placed over the hub. The cable may be fully coiled or it may be partially coiled. An example of a fully coiled cable is illustrated in FIG. 5*a*, and an example of a partially coiled cable is illustrated in FIG. 5*b*. The cable coil may be bundled (e.g., secured with ties) when it is put over the hub. The ties may be cut off after the coil has been placed over the hub.

At block 440, the locking arm is disengaged, the spring biases the center body away from the end plate, and the hub surface expands. As the hub surface expands, it presses against the coil. In addition, the center body may be manually pulled up against the stop on the center shaft to lock it in place. Otherwise, the pressure from the coil might cause the hub surface to retract. The expanded hub surface will prevent the cable from freewheeling while the spool is rotated during despooling or spooling.

At block 450, an end plate may be interlocked with the free end of the hub's center shaft. The end plate ensures that the cable doesn't come of the hub. The outer diameter of the end plate, along with the other end plate, creates a surface on which the spool can roll.

The free end of the cable may be attached to one of the end plates (e.g., using a Velcro strap) so as not to "slap" during spooling or despooling. An end plate may be designed so this attachment can be made anywhere around the circumference of the end plate. For example, a thin slot may be cut into the inside edge of an end plate, leaving a very narrow ring around which a strap is wrapped.

At block 460, the spool can be rotated either clockwise or counterclockwise for despooling or spooling. Despooling may be performed by pulling on the cable. Spooling may be performed by rotating the spool, while keeping the cable in tension. If the cable is completely uncoiled, it can be wrapped around the hub a few times by hand to get it started.

Both despooling and spooling will cause the coil to be tightened. The combination of the stop and the pressure from the inside of the coil keeps the center body in the expanded position. Because the hub arms are angled away from the end plate, the inward pressure forces the center body to press against the stop and hold the hub in an expanded and fixed position.

The spool may be loaded on a structure that allows the spool to rotate. For example, the spool could be loaded on the reel platform 710 illustrated in FIG. 7. In the alternative, the hub may have an axial opening, which allows the spool to be slid onto an axle (e.g., an upright axle, or an axle extending horizontally from an upright support).

At block 470, after spooling or partial despooling has been completed, the end plate is removed, the hub surface is retracted, and the cable coil is removed from the hub. The coil may be bundled (e.g., secured with ties) before it is removed from the hub.

Advantages of a spool according to an embodiment of the present invention include speed and reusability. The retractable hub allows for rapid loading and unloading of coils. A spool can be used for full despooling or partial despooling of a coil, and it can be used for quick spooling of either a fully despooled cable or partially despooled coil. Once the cable has been spooled (either partially of fully), the coil can be removed from a spool and placed to the side. Later, the coil may be placed back on the spool and spooled further or despooled.

The hub is designed to ensure that the coil does not freewheel during either despooling or spooling. The hub is also designed so a single person can quickly, conveniently and ergonomically retract the hub surface and load a coil onto the spool.

Spools can be cascaded and interlocked, whereby multiple coils of cable can be despooled or spooled simultaneously. The spool assembly is scalable. A desired number of spools can be cascaded and interlocked quickly. The spool assembly saves significant time and provides ergonomic benefit when despooling multiple coils. Moreover, the spool assembly can be loaded and the despooling can be carried out, easily, quickly and ergonomically by a single person.

Figure 6:
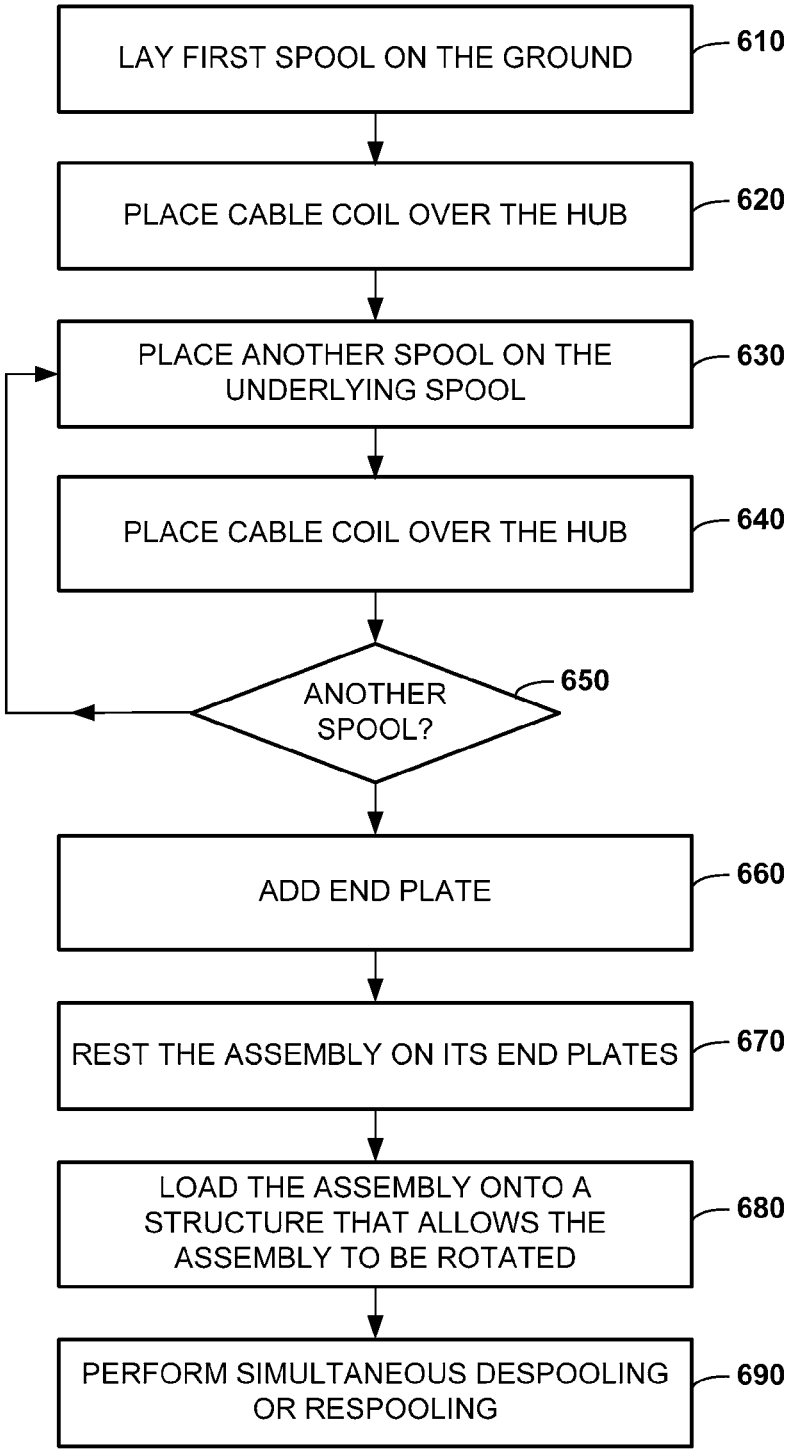
FIG. 6 is an illustration of a method of using multiple spools in accordance with an embodiment of the present invention.

Reference is now made to FIG. 6, which illustrates a method of using multiple spools. At block 610, a first spool is laid flat on the ground, end plate first. At block 620, a cable coil is placed around the hub of the first spool, and any cable ties holding the coil are cut loose. At block 630, a second spool is placed on the underlying spool, and the bearing of the second spool is interlocked with the center shaft of the underlying spool. At block 640, a cable coil is placed over the hub of the second spool. Additional spools may be cascaded (block 650) by repeating the functions at blocks 630-640. After the last spool has been cascaded, an end plate is interlocked with the center shaft of the last spool (block 660).

At block 670, the spool assembly is rotated 90 degrees so it is resting on the perimeter of its end plates. At block 680, the assembly is loaded onto a structure (e.g., the reel platform 710 of FIG. 7) that allows the assembly to be rotated.

At block 690, simultaneous despooling or spooling of multiple cables is performed. Simultaneous despooling may be performed conveniently by pulling out the non-attached ends of cable. Simultaneous spooling may be performed conveniently by rotating the spool assembly. A crank, an electric motor, or other device may be used to help rotate the spool assembly.

Cables are kept neatly coiled during despooling and spooling. Neat partial coils can be put right back on their spools and either spooled or despooled simultaneously.

Figure 7:
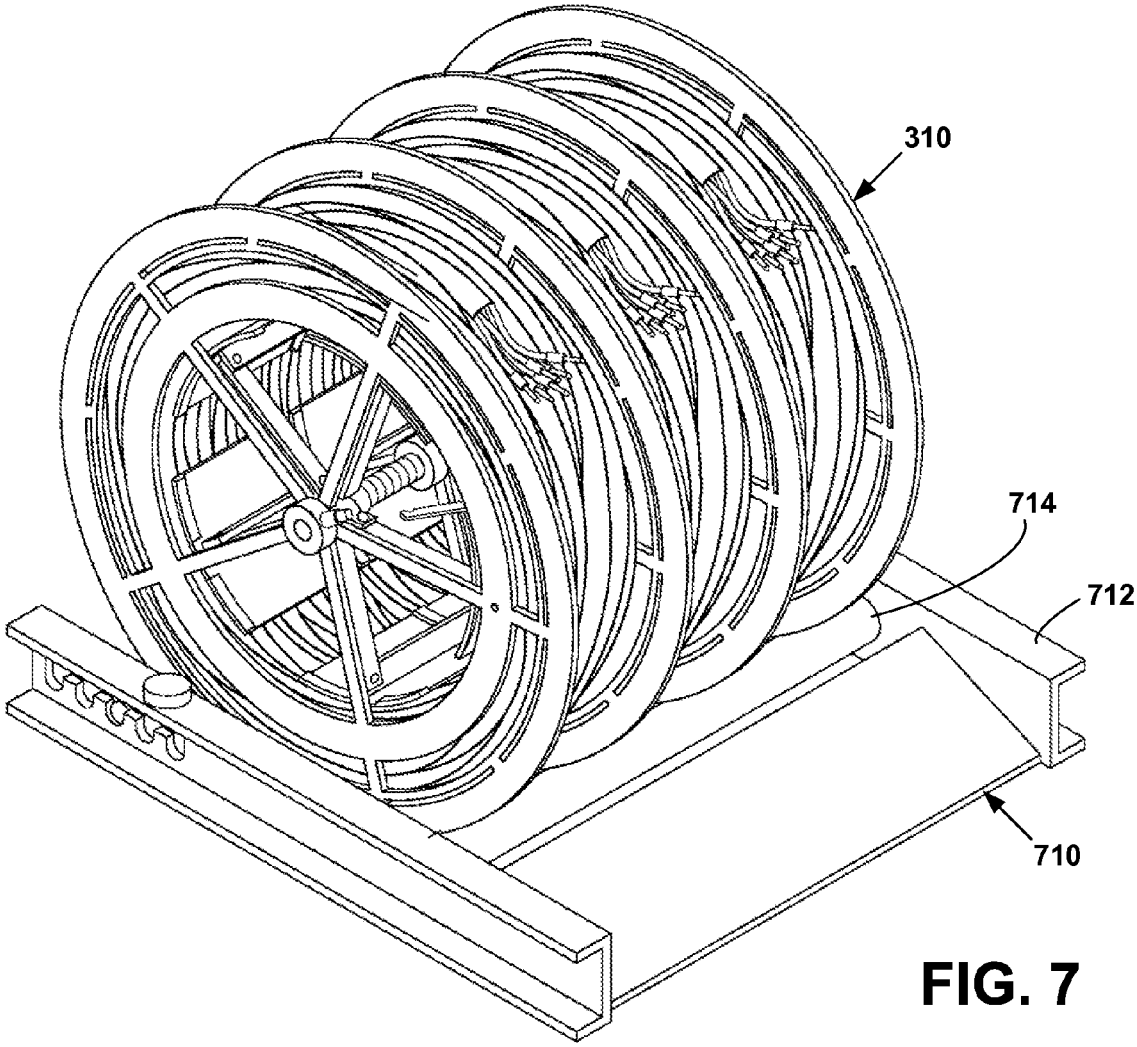
FIG. 7 is an illustration of a spool assembly and reel platform in accordance with an embodiment of the present invention.

Additional reference is made to FIG. 7, which shows a spool assembly 310 on a reel platform 710. The reel platform 710 includes a base 712 with spaced apart rollers 714 for accommodating the assembly in a vertical orientation (the reel platform 710 can also accommodate a single spool). The rollers 714 allow the assembly 310 to rotate in place while cables are being despooled or spooled. The base may also include a ramp for making it easier to roll the assembly 310 onto the rollers 714.

An embodiment of the present invention is not limited to a support structure such as the reel platform 710 of FIG. 7. For instance, the center bodies of one or more hubs could be configured to slide onto an axle.

However, the reel platform 710 of FIG. 7 has advantages in that the spool assembly 310 doesn't have to be lifted off the ground. The assembly 310 can simply be tilted 90 degrees and rolled onto the reel platform 710. This operation can be performed by a single person. By not having to lift more than one spool at any time, the risk of injury is reduced. The heaviest single item that has to be lifted during despooling or spooling is a single cable coil since the loading of cable coils onto the spools is set up as a stacking operation.

Because each spool has only one end plate, the overall weight and length of the spool assembly is reduced, making the spool assembly easier to handle and also reducing the risk of injury. The combination of the spool assembly and reel platform is also compact, which allows cable to be despooled and spooled in tight quarters.

Spooling and despooling according to an embodiment of the present invention is application-specific. In the test and measurement environment, for instance, cables are despooled and then spooled while setting up and tearing down instrumentation. However, despooling and spooling according to an embodiment of the present invention is not limited to the test and measurement environment. Other uses include, but are not limited to, convention centers, concerts, and telecommunications.

The invention claimed is:

1. A cable spool comprising:

a hub having a discontinuous hub surface that is retractable and expandable, the hub including a shaft, a center body slidable over the shaft, arms that are connected to the center body and that extend radially outward from the center body, and surface pieces at ends of the arms, the surface pieces forming the discontinuous hub surface; and a single circular, flat end plate affixed to an end of the hub, the end plate having spokes;

wherein an upper edge of each surface piece has a notch configured to receive a spoke of a second spool such that the upper edges of the surface pieces are slidable along the spokes of the second spool.

2. The spool of claim 1, wherein first ends of the surface pieces are hinged to the spokes of the end plate and second ends of the surface pieces are hinged to ends of the arms.

3. The spool of claim 1, wherein the hub surface retracts when the center body is moved toward the end plate.

4. The spool of claim 1, further comprising a stop for constraining movement of the center body away from the end plate.

5. A method of using the spool of claim 1 to spool or despool a coil of cable, the method comprising laying the end plate on the ground;

placing the cable coil over the hub when the hub surface is retracted;

expanding the hub surface to prevent the cable from free-wheeling; and rotating the spool.

6. The method of claim 5, further comprising retracting the hub after rotating the spool; and removing a partial coil from the retracted hub.

7. A method of using a plurality of spools of claim 1 to despool or spool a plurality of cable coils, the method comprising cascading a plurality of the spools, wherein cascading each spool includes:

laying an end plate of an $n^{th}$ spool on the shaft of an n-1th spool;

placing a coil over a retracted hub of the $n^{th}$ spool; and expanding the hub of the $n^{th}$ spool;

after all of the spools have been stacked and interlocked, loading the interlocked spools on a structure that allows the interlocked spools to rotate; and simultaneously despooling or spooling the cables from the interlocked spools.

8. The method of claim 7, further comprising bundling and removing partial coils from the hubs.

9. The spool of claim 1, wherein the shaft is coupled to the end plate by a bearing, the bearing configured to receive a shaft of another spool.

10. Apparatus comprising first and second cascaded, temporarily interlocked spools for simultaneous cable spooling and despooling; each spool including a single circular, flat end plate having spokes, and a hub having a discontinuous hub surface that is retractable and expandable, the hub including a shaft coupled to the end plate by a bearing, a center body slidable over the shaft, arms that are connected to the center body and that extend radially outward from the center body, and surface pieces at ends of the arms, the surface pieces forming the discontinuous hub surface;

wherein the shaft of the first spool is inserted into the bearing of the second spool; wherein the spokes of the second spool are received in notches in upper edges of the surface pieces of the first spool; and wherein the end plate of the second spool forms a terminating plate for the first spool.

11. The apparatus of claim 10, further comprising means for supporting the interlocked spools to rotate for the spooling or despooling.

12. The apparatus of claim 11, wherein the supporting means includes a base that carries spaced apart rollers for accommodating the interlocked spools while the interlocked spools are resting on the perimeter of its end plates.

* * * * *